United States Patent [19]

Pomeroy

[11] Patent Number: 4,470,594

[45] Date of Patent: Sep. 11, 1984

[54] PORTABLE EXERCISE DEVICE

[76] Inventor: Gary G. Pomeroy, 172 S. Livingston Ave., Livingston, N.J. 07039

[21] Appl. No.: 351,782

[22] Filed: Feb. 24, 1982

[51] Int. Cl.[3] ..... A63B 23/04

[52] U.S. Cl. ..... 272/73

[58] Field of Search ..... 272/73, 132, 114; 128/25 R; D21/194

[56] References Cited

U.S. PATENT DOCUMENTS

| | | | |
|---|---|---|---|
| 2,668,709 | 2/1954 | Boyko | 272/132 |
| 2,673,088 | 3/1954 | Wentz | 272/132 X |
| 2,722,882 | 3/1973 | Patrick | 272/73 |
| 3,224,765 | 12/1965 | Baker et al. | 272/132 |
| 3,563,541 | 2/1971 | Sanquist | 272/73 |
| 3,968,963 | 7/1976 | Sileo | 272/73 X |
| 4,007,927 | 2/1977 | Proctor | 128/25 R X |
| 4,079,931 | 3/1978 | Valentine et al. | 272/73 |
| 4,265,447 | 5/1981 | Shafer | 272/73 |
| 4,390,177 | 6/1983 | Biran et al. | 272/73 |

FOREIGN PATENT DOCUMENTS

| | | | |
|---|---|---|---|
| 461839 | 10/1968 | Switzerland | 272/73 |
| 1210722 | 10/1970 | United Kingdom | 272/73 |

*Primary Examiner*—Robert A. Hafer
*Assistant Examiner*—Arnold W. Kramer
*Attorney, Agent, or Firm*—Richard T. Laughlin

[57] ABSTRACT

A portable exercise device for use with the user's legs at various locations. The device comprises a frame, feet for resting on a surface, handle-bars for gripping the device and a pedal arrangement. The pedal arrangement is adjustable to allow different degrees of force to be applied to the pedals while in use.

4 Claims, 5 Drawing Figures

FIG. 1
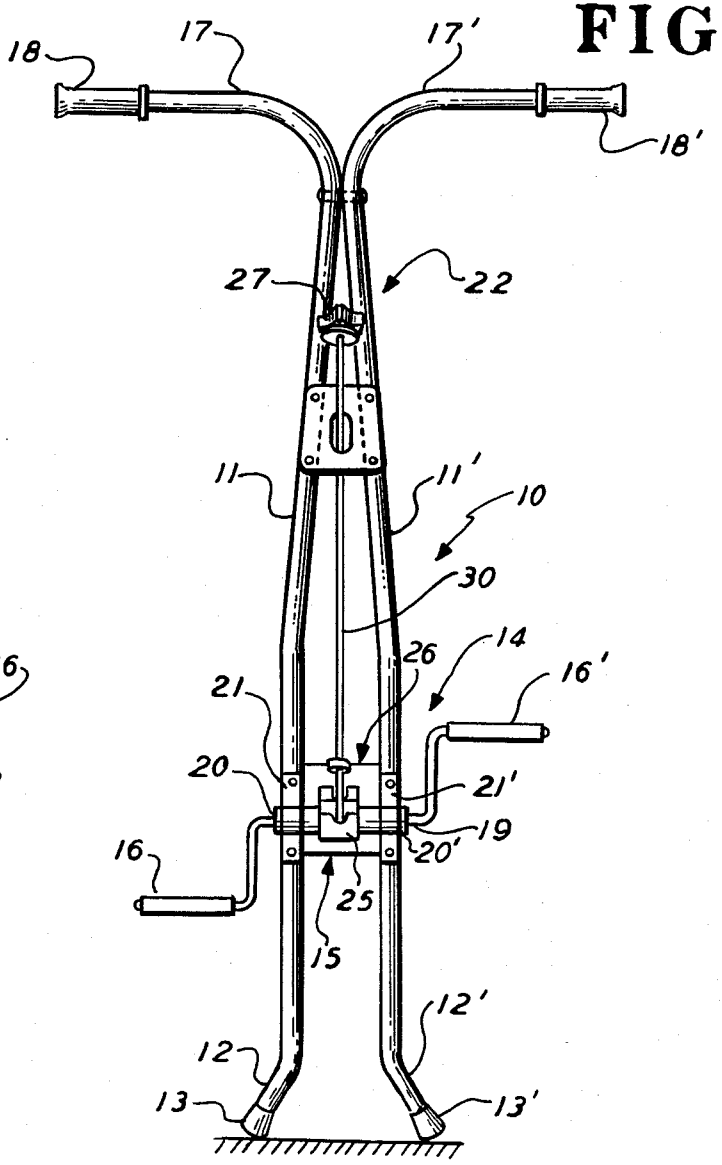
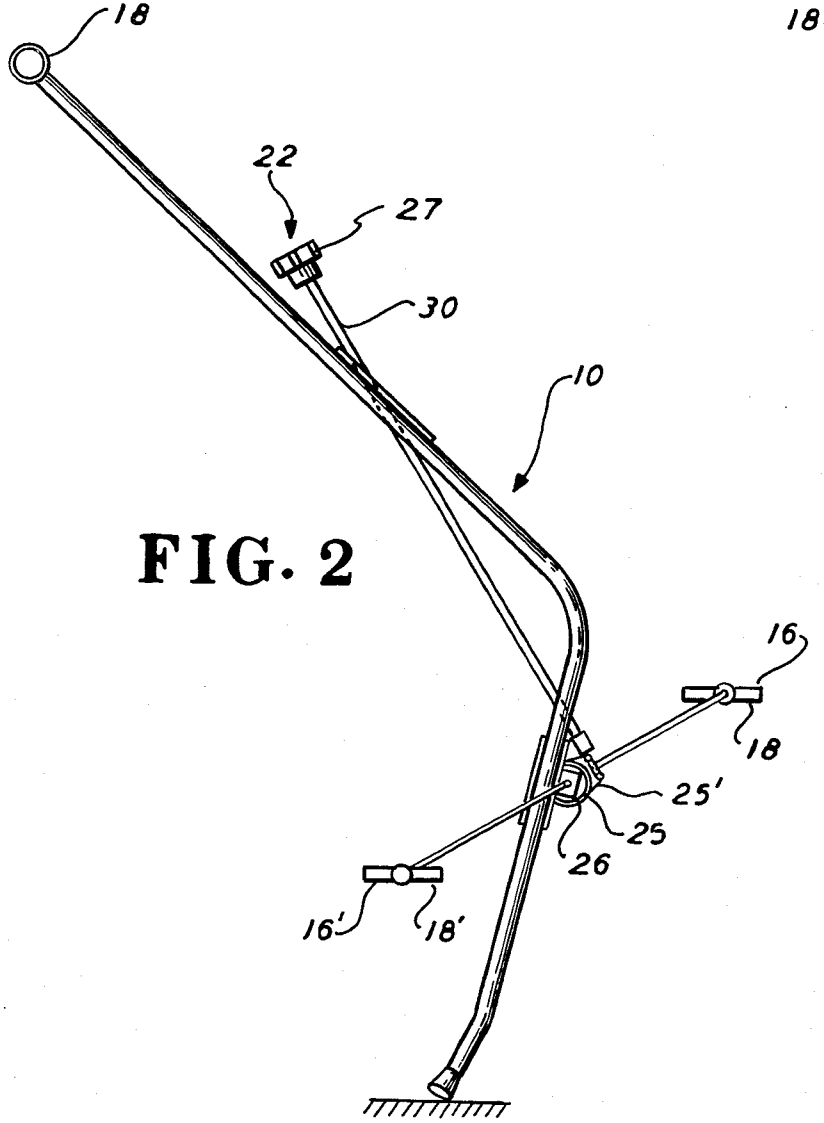
FIG. 2

PORTABLE EXERCISE DEVICE

BACKGROUND OF THE INVENTION

In recent years there has been an increasing emphasis on physical fitness. Pedaling against a resistance such as encountered during bicycle riding is a particularly effective mode of physical exercise. In order to enable one to gain the benefits of pedaling without requiring one to go outdoors various stationary bicycle exercising devices are commercially available. Typical of such devices are those disclosed in U.S. Pat. Nos. 3,578,800, issued May 18, 1971; 3,572,699, issued Mar. 30, 1971; and 4,007,927, issued Feb. 15, 1977. These devices function very effectively for physical fitness but have the disadvantage that they are bulky and primarily stationary, which limits the place in which they can be used. Portable exercise devices have been suggested. Typical of such devices are those shown in the following U.S. Pat. Nos. 4,225,130, issued Sept. 30, 1980 to J. Zimmerman; 3,751,033, issued Aug. 7, 1973 to W. Rosenthal. Also such exercise devices for use with conventional chairs are shown in U.S. Pat. Nos. 3,759,512, issued Sept. 18, 1973, to A. Yount; 2,668,709, issued Feb. 9, 1954 to R. Boyko; 3,968,963, issued July 13, 1976; and 4,222,376, issued Sept. 16, 1980 to L. Praprotnik. Further, a stool type apparatus is shown in U.S. Pat. No. 3,443,664, issued May 13, 1969, to J. Frassanito et al. All of these devices require rigid connection to the chair and are bulky as are many of the conventional static bicycle devices.

One of the greatest problems to overcome in promoting the continuous use of such devices is boredom. In order to obtain the necessary exercise, a considerable length of time has to be spent in one location and day after day. It is apparent therefore that it would be desirable to have a truly portable device which could be moved from place to place easily allowing different environments for its use, thereby allowing substantial reduction in the boredom factor.

SUMMARY OF THE INVENTION

This invention relates to a portable exercise device, and more particularly to such a device of the bicycle pedal type and which enables the user to regulate the exertion and frictional resistance and thus the amount of tension opposing the muscular effort exerted by the user.

It is an object of the invention to provide a portable exercising device that can be easily moved from place to place and stored in a relatively small area. It is another object of the invention to provide such a device which is light weight and stable in use. It is a further object of the invention to provide a portable exercise device which can be adjusted to vary the amount of force required to use the device. It is still a further object of the invention to provide such a device which is small and quiet in operation. Other objects and the advantage of the invention will appear from the following description.

In accordance with the invention a portable exercise device is provided comprising a light-weight frame having two complementary curved legs, handle-bars for gripping the device when in use, pedals mounted mid-way on the frame for revolving in a circular path, tension means for providing pressure resistance to the pedal movement and adjustment means for adjusting the resistance to the rotation of the pedals.

BRIEF DESCRIPTION OF THE DRAWINGS

FIG. 1 is a schematic diagram of an embodiment of the portable exercising device of the invention.

FIG. 2 is a side view of the exercise device shown in FIG. 1.

DETAILED DESCRIPTION OF THE PREFERRED EMBODIMENT

Figure 3:
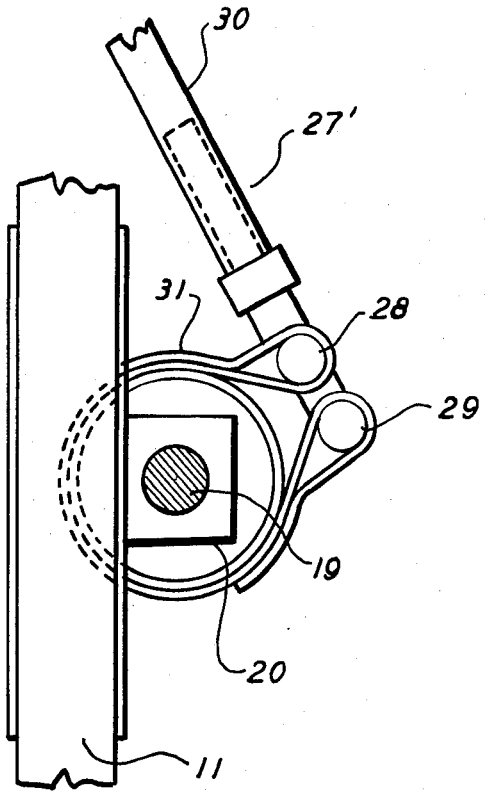
FIG. 3 is an enlarged view of part of the portable exercising device of FIG. 1 showing the means for creating resistance to the rotation of the pedals.

Referring to the drawings the illustrative embodiment of the invention comprises a frame component, generally indicated at 10, of light-weight metals such as aluminum or steel tubing. The frame however can be made of other materials such as a box design or molded from plastic. The shape of the frame is one of the essential embodiments of the invention. Tubing frame is bent to provide outwardly flaring legs 12,12'. Each leg is provided with a frictional element 13,13' to prevent sliding when in contact with the floor or operating surface. Typical of such friction elements are rubber caps on the end of the tubing or composition bands around the leg elements. The frame extends vertically upward from the operating surface to a pedal device, generally indicated at 14, which contains a friction or tension device, generally indicated at 15, for creating various degrees of resistance to the rotation of the pedals 16, 16'. The location of the pedal device is sufficiently above the floor to allow the free movement or rotation of the pedals without contacting the floor. The frame then extends in a generally curving fashion towards the user of the apparatus, and terminates in a flare arrangement 17, 17' which can be in the form of handles 18, 18' for the user to grip the apparatus.

The frame is preferably made of two identical pieces of tubing 11, 11' being mirror images of each other. The two frames are spaced apart to allow insertion of the pedal device 14 or assembly. The pedal assembly is arranged to rotate about the longitudinal axis of an axle 19 extended through the frames, by the application of force to the pedals by the user. The axle is held on the frame in bearings 20, 20' secured to the frame by plates 21, 21'. If desired, the pedals can be provided with stirrups for holding the feet of the user on the pedals.

The tension means 15 can be of various construction. The tension means shown in FIG. 1 includes adjusting means, generally indicated at 22, for adjusting the amount of friction applied to the axle 19 so that the user can adjust the desired resistance to provide the amount of physical exertion he desires. The friction adjusting means basically comprises a clamp or sleeve 25 having a frictional material lining 25' such as a fibrous material. The sleeve is mounted in a holder assembly, generally indicated at 26 affixed between the bearings, and surrounds the mid-point of the axle.

A tension bar 30 is provided for adjusting the force extent on the axle. The tension bar 30 or rod is affixed to the frame to allow rotation of the bar. At one end of the bar is a knob 27 or the like to allow the user of the apparatus to rotate the bar both clockwise and counterclockwise. The opposite end 27' is provided with a stationary fixed station 28 and an adjustable station 29. The adjustable station moves toward or away from the fixed station as the tension bar is rotated. A metal strip 31 is affixed at opposite ends to the individual stations passing around the axles.

As is appreciated by those skilled in the art, by tightening the tension bar via the rotation of its handle, stations are brought together. This action squeezes the metal strap more tightly about the periphery of the axle extending therethrough. Accordingly greater frictional engagement is made between the surface of the axle and the strap, whereupon greater force is necessary to be applied to the pedals to effect rotation of the pedal unit. Conversely, moving the stations apart results in a decreasing of the frictional engagement between the metal strap and the axle so that less force is necessary to be applied to the pedals to rotate the pedal unit.

The friction applying device for applying a force against the rotation of the axle can take a number of other forms. Types of suitable devices are shown in FIGS. 5 and 4 of the drawings.

Figure 5:
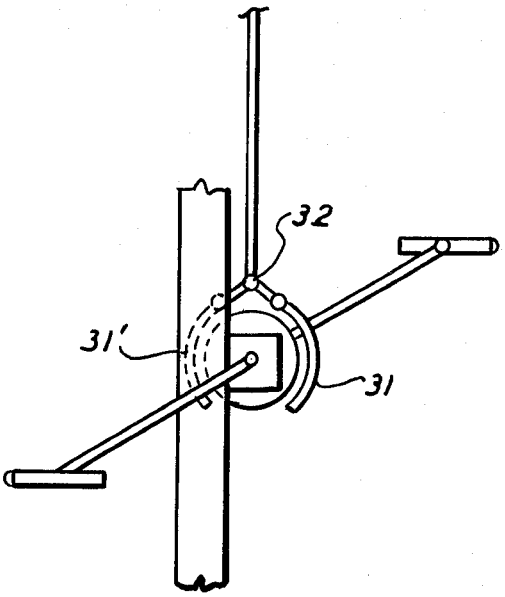
FIG. 5 is another method for applying resistance to the motion of the pedals in the exercising device of the invention.

In one modification shown in FIG. 5 the friction is applied by opposing calipers 31,31'. The tension bar 30 is provided with a threaded portion 32 on one end which passes into the calipers. Rotation of the bar clockwise will cause the calipers to close and in the opposite direction to open. Composition material is placed on the inside of the calipers which presses against the axle thereby supplying the necessary frictional force.

Figure 4:
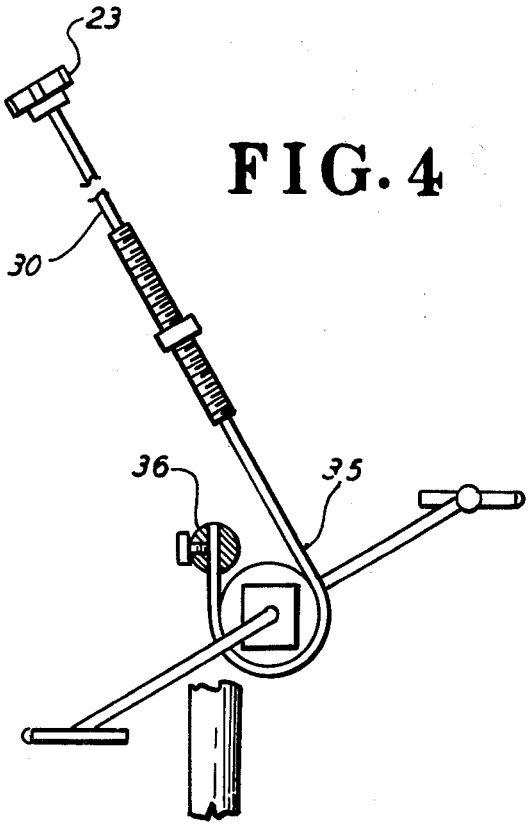
FIG. 4 is another method for applying resistance to the motion of the pedals in the exercising device of the invention.

Another frictional apparatus device is shown in FIG. 4. This device consists of a strap 35 which passes around a portion of the axle and is affixed at one end 36 to the frame. The strap can be composition material such as that used conventionally in automobile brake linings. Alternatively the strap can be lined with such material. The opposite end of the strap is affixed to the tension bar 30 described hereinabove and operates in similar fashion.

While the invention has been described with reference to its preferred embodiment thereof, it will be appreciated by those of ordinary skill in the art that various changes can be made in the process and apparatus without departing from the basic spirit and scope of the invention.

What is claimed is:

1. A portable exercising device comprising in combination:

a pair of rigid curved tubular frame members having mirror image contours, the forward sections of which are disposed in substantially parallel spaced-apart relation to form a pair of supporting substantially vertically-disposed legs each terminating in feet bent outwardly from one another at approximately 45° to form a stable supporting base;

the mid-sections of said frame members being curved rearwardly in cantilevered fashion from the principal plane defined by said legs through matching arcs approximating about 120° in a plane normal to said plane to form shank sections terminating in a pair of handle bars which protrude in diametrically-opposite directions substantially normal to said shank sections;

said shank sections being fastened together just below said handle bars;

and said legs being maintained in said parallel spaced-apart relation by a fixed spacer fastened therebetween just below said arcs and comprising bearing means;

an axle rotatably mounted in said bearing means and terminating at diametrically-opposited ends in a pair of foot pedals;

means constructed and arranged to impose frictional contact on said axle for controlling the force required to rotate said axle.

2. The combination in accordance with claim 1 wherein said means constructed and arranged to impose frictional contact on said axle comprises a split sleeve lined with frictional material at least partially surrounding said axle; and a tension bar connected to said sleeve, said bar extending to an area adjacent said handle bars, and terminating in a knob for tightening said sleeve including said frictional material against said axle.

3. The easily portable device of claim 1 wherein said frictional means for controlling the force required to rotate the axle comprises two opposing calipers fitted with frictional pads for controlling such axle.

4. The easily portable device of claim 1 wherein said frictional means for controlling the force required to rotate the axle comprises a strap of friction material contacting at least a portion of said axle, one end of said strap being affixed to the frame and the opposite end of said strap being affixed to a tension bar for adjusting the force said strap exerts on said axle.

* * * * *